US010646041B1

(12) United States Patent
Garrido

(10) Patent No.: US 10,646,041 B1
(45) Date of Patent: May 12, 2020

(54) PROTECTOR FOR CABINET OR DRAWER EDGE

(71) Applicant: Faridh Garrido, Carlsbad, CA (US)

(72) Inventor: Faridh Garrido, Carlsbad, CA (US)

( * ) Notice: Subject to any disclaimer, the term of this patent is extended or adjusted under 35 U.S.C. 154(b) by 13 days.

(21) Appl. No.: 15/901,816

(22) Filed: Feb. 21, 2018

Related U.S. Application Data

(60) Provisional application No. 62/600,487, filed on Feb. 21, 2017.

(51) Int. Cl.
*A47B 96/20* (2006.01)
*A47B 97/00* (2006.01)

(52) U.S. Cl.
CPC ..... *A47B 96/201* (2013.01); *A47B 97/00* (2013.01)

(58) Field of Classification Search
CPC ..... A47B 96/201; A47B 97/00; A47B 2200/0007
See application file for complete search history.

(56) References Cited

U.S. PATENT DOCUMENTS

| | | | | |
|---|---|---|---|---|
| 2,243,841 | A | 4/1940 | Di Bella | |
| 2,514,001 | A | 2/1945 | Knuth | |
| 2,743,980 | A | 1/1953 | Hobbs | |
| 4,443,508 | A | 4/1984 | Mehl | |
| 4,878,257 | A * | 11/1989 | Hardin | E03C 1/181 4/658 |
| 5,280,692 | A * | 1/1994 | Patey | E04B 5/12 52/58 |
| 5,772,185 | A * | 6/1998 | Pulsipher | E04D 3/405 256/1 |
| 6,564,398 | B1 | 5/2003 | Trott | |
| 8,667,744 | B2 * | 3/2014 | Shaw | E04F 15/04 52/483.1 |
| 2008/0256897 | A1 | 10/2008 | Lowry et al. | |
| 2011/0011467 | A1 | 1/2011 | Fillhart | |

* cited by examiner

*Primary Examiner* — Anita M King
(74) *Attorney, Agent, or Firm* — Palomar Patent; MaryJo Redman; Calif Teruo

(57) ABSTRACT

Cabinet protectors are flexible, resilient U-channels for mounting on the upper edge of a cabinet door or drawer front to protect the edge from impact and wear. Protector strips include diverter flange that diverts liquids that spill or splash from above away from cabinet face, so that liquids drip to floor below instead of damaging cabinet. Side walls of U-channel slant together to grip door or drawer edge tightly without adhesive or other fastener.

5 Claims, 5 Drawing Sheets

PROTECTOR FOR CABINET OR DRAWER EDGE

CROSS-REFERENCE TO RELATED APPLICATIONS

This application claims the benefit of U.S. Provisional Application No. 62/600,487, filed Feb. 21, 2017.

FIELD OF THE INVENTION

This invention relates generally to a protective cover for a small structural member, and more particularly to a cover for an edge of a cabinet door or a drawer front that is adapted for diverting liquid away from a face of the protected member.

BACKGROUND OF THE INVENTION

Storage cabinets and drawers near a sink, such as in a kitchen, bathroom, or laboratory, are often damaged or made unsightly due to liquids that are splashed or dripped onto the cabinet doors and drawer fronts. In addition to water, other liquids that may be spilled include cleaning chemicals, food waste from dirty dishes and pots, and juices from food being prepared.

If liquids pool atop a cabinet door edge or similar surface, either frequently or for a long time, the liquids may soak into the wood or other material and cause swelling, warping, or breaking down of the material. Liquids that run down a face of a door or drawer create streaks as they dry and may seep backward under the bottom edge of the face. Significant amounts of liquid may even run inside the cabinet or drawer over the top edge of the door or front.

This uncontrolled liquid flow can cause permanent damage to the cabinet or drawer, as well as damaging the contents of the cabinet or drawer, encouraging the growth of mold and bacteria, or providing moisture and food for insects.

Of course, proper sink, faucet, and countertop designs play an important part in minimizing drips and splashes. Cabinets and drawers can be made of impermeable materials and can be made to seal liquid-tight. But accidental spills and splashes will still occur around sinks, even well-designed ones. Cabinets and drawers are expected to be attractive, economical, and convenient as well as resistant to damage. Thus, cabinets and drawers are rarely made to be completely splash- and spill-proof.

The problems caused by uncontrolled liquids around sinks have not yet been solved by improved design or materials. In fact, a feature often used in the latter half of the 20th century, a raised band along the front edge of the counter top, has been discarded. Many, if not most, countertops installed in the past twenty years have front edges that actually encourage liquid to run off, such as radiused, bullnose, beveled, and crescent outlines.

Many under-sink cabinet and drawer materials used in laboratories are relatively resistant to damage from common liquids. However, even these cabinets do not generally seal liquid-tight because such cabinets would be much more expensive and less convenient to open and close. In private homes, current taste tends toward more complex decorative design and exotic materials. Many homeowners choose kitchen and bathroom cabinets because they love the look and feel of the materials, not for their impermeability and resistance to liquids.

Most countertops are designed to overhang the cabinets below, that is, the counter extends two or more inches outward from the face of the cabinet. On casual inspection, an overhang might be expected to cause any liquids that run off the countertop to fall directly to the floor, without contacting the cabinet below. In practice, though, this is not the case. Cabinets and drawers below overhanging countertops are still vulnerable to liquid spills.

Patent application US 2011/0011467 A1 of Fillhart, published in January 2011, asserts that a bullnose edge countertop that extends beyond the cabinet below not only allows liquid to flow off the edge, it directs the liquid to bend backward from the overhanging edge to splash the cabinet below (para. 007; see also FIGS. 1A and 1B). It seems likely that other popular decorative edges for countertops would have the same effect. Fillhart discloses a drip guard to be glued to the underside of the countertop overhang. According to the Fillhart disclosure, the drip guard successfully diverts liquids away from the cabinet face. However, the drip guard itself cannot be easily removed for cleaning and looks as though it creates a difficult-to-clean crevice (FIGS. 2A and 2B) that would quickly become unhygienic.

There is thus a need for a means to divert liquid that spills off a countertop, overhanging or not, away from the cabinet below without creating a different cleaning problem. A suitable cabinet protection means would particularly guard the upper edges of cabinet doors and drawer fronts from any contact with liquids, while preventing entrance of liquids into the interiors of the cabinets and drawers. It is further desirable that a cabinet protector not detract from the decorative appearance of the cabinet nor make use of the cabinet less convenient.

SUMMARY OF THE INVENTION

The cabinet protector of the invention is adapted for mounting on the door of a cabinet or the front of a drawer, including flanges to divert liquid that is dripped or splashed toward the cabinet or drawer so that the liquid falls to the floor without contacting the cabinet face.

The cabinet protector typically includes a strip of resilient U-channel edging, which includes two side walls and a top wall connecting the sides such that the inner faces of the three walls define a central channel. In a preferred embodiment that is described in detail below, the central channel is rectangular in cross-section and includes a flange on one or both side walls.

In the case of two opposing flanges, the flanges are preferably different in profile so that the protector strip may be mounted on the cabinet door or drawer with the preferred flange on the outside of the cabinet, which generally is exposed to more spills and splashes than the inside. This allows the user to experiment and adopt the protector strip to the individual situation.

The two side walls are generally vertical and parallel to each other, but preferably they slant together from top to bottom. The width of the central channel is slightly greater at the top than at the bottom, so that the protector is easy to slide onto the door or drawer to be protected yet grips the surface tightly so that it is secured in place by friction.

A second preferred embodiment described in detail below is quite similar in design but includes a very large flange that can function as a finger-pull opener for a cabinet door or drawer.

A third preferred embodiment described below includes a vertical side wall and a horizontal top wall, as in the first embodiment, but the second side wall is shaped to fit over an ornamental cabinet member, such as a framed or raised panel type door or drawer.

The cabinet protector is created by extruding or molding suitable plastics, which must be resilient, tough, and resistant to most liquids and semi-liquids found in a kitchen, including hot water, oil, detergent, ammonia, and bleach. A suitable material also preferably has relatively high friction in combination with the materials commonly used for cabinet doors and drawers.

The protectors can be easily cut to fit and are typically mounted without the use of adhesive or tools. They can be removed for cleaning and readily re-installed many times.

Cabinet protectors placed on the upper edges of kitchen cabinet doors and drawer fronts divert liquids away from cabinets to prevent cosmetic and structural damage, as well as protecting the edges from minor impacts and wear from frequent handling. The protectors also block gaps between cabinet members to help prevent intrusion of liquids inside the cabinet.

Cabinet protectors can be adapted to fit any popular profile for doors and drawers and are compatible with child-resistant latches or other locks. They may be colorless or tinted to match or harmonize with popular cabinet colors, may be transparent or opaque, and glossy, satin, or matte finished. Thus, they do not impair the look or convenient use of the cabinets.

The cabinet protectors are fairly easy and inexpensive to manufacture, especially as compared to the potential damage to cabinets and goods that they prevent. The materials used are typically soft enough that they cannot scratch or bruise anyone who bumps or leans against the protector, although this is not a necessary limitation of the invention.

The invention will now be described in more particular detail with respect to the accompanying drawings in which like reference numerals refer to like parts throughout. Other features and attendant advantages of the invention will become more apparent upon a reading of the following detailed description.

DETAILED DESCRIPTION OF THE INVENTION

Figure 1:
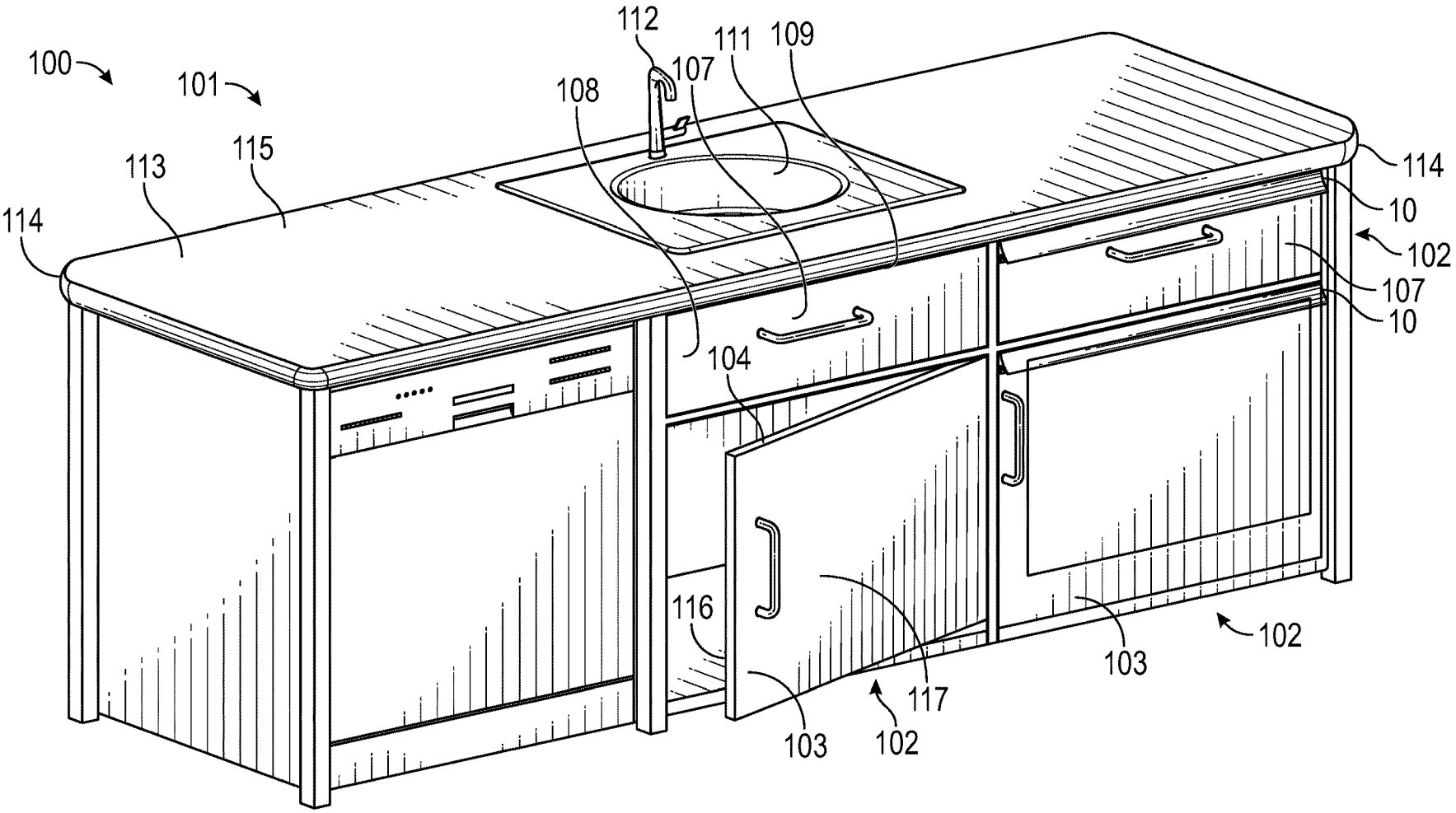
FIG. 1 is an environmental perspective view of a typical sink cabinet with cabinet protectors mounted on two cabinet members.

FIG. 1 is an environmental perspective view of a typical cabinet 100, such as sink cabinet 101, as found in kitchens or "wet" laboratories, with two cabinet protectors 10 of the present invention mounted on cabinetry members 102, such as a cabinet door 103 and a drawer front 108. Protectors 10 protect top edge 104 of cabinet door 103 and top edge 109 of drawer front 108 from impacts and wear; they also include liquid diversion means such as flange 60 for diverting liquids away from the faces of door 103 and drawer front 108, such as exterior face 117 of a cabinetry member 102.

In normal use, protectors 10 would be installed on both cabinet doors 103 and both drawer fronts 108, but protectors 10 are omitted from the left cabinet members 102 for clarity of view. Protectors 10 are especially beneficial near a water source or in an area where spills occur; they are also useful for trash compactor drawers and other messy areas, as well as for cabinet members 102 that are expected to be handled often.

Sink cabinet 101 includes a water source such as faucet 112, a water containing reservoir such as sink 111, and a countertop 113. As seen in the drawing, countertop 113 extends slightly past the front face of cabinet 100 and has a work surface 115 and an edge 114 with rounded profile, that is, a "bullnose" edge. Bullnose and similar curved profiles are very popular because they are less painful to bump against and are less likely to be chipped than edges with sharp square corners. However, as discussed above, curved countertop edges 114 do nothing to impede the flow of water from work surface 115 of countertop 113 onto cabinet 100 below. Although countertop edge 114 typically overhangs cabinet 101 by an inch or more, a curved edge 114 can cause liquid that drips off to bend back and splash or flow onto cabinet 101.

A mechanical dishwasher is located to the left of sink cabinet 101, as is common in home kitchens and laboratories. Dishes, cooking pots, or lab glassware are often rinsed in sink 111 then put into the dishwasher. This process can splash a lot of water or other materials onto work surface 115 and water may fall directly off of vessels being transferred to the dishwasher and onto the front of cabinet 100. Dishes, cutlery, or food items may be dropped in front of cabinet 100 and may strike edges 104, 109 if a cabinet door or drawer is ajar. In general, the top edges 104, 109 of a cabinet 100 will look worn and grimy faster than other surfaces of cabinet 100.

Cabinet protector 10 may be mounted on any available edge of a cabinet member 102, but top edges 104, 109 are the usual preferred locations because of the greater potential for damage there.

Figure 2:
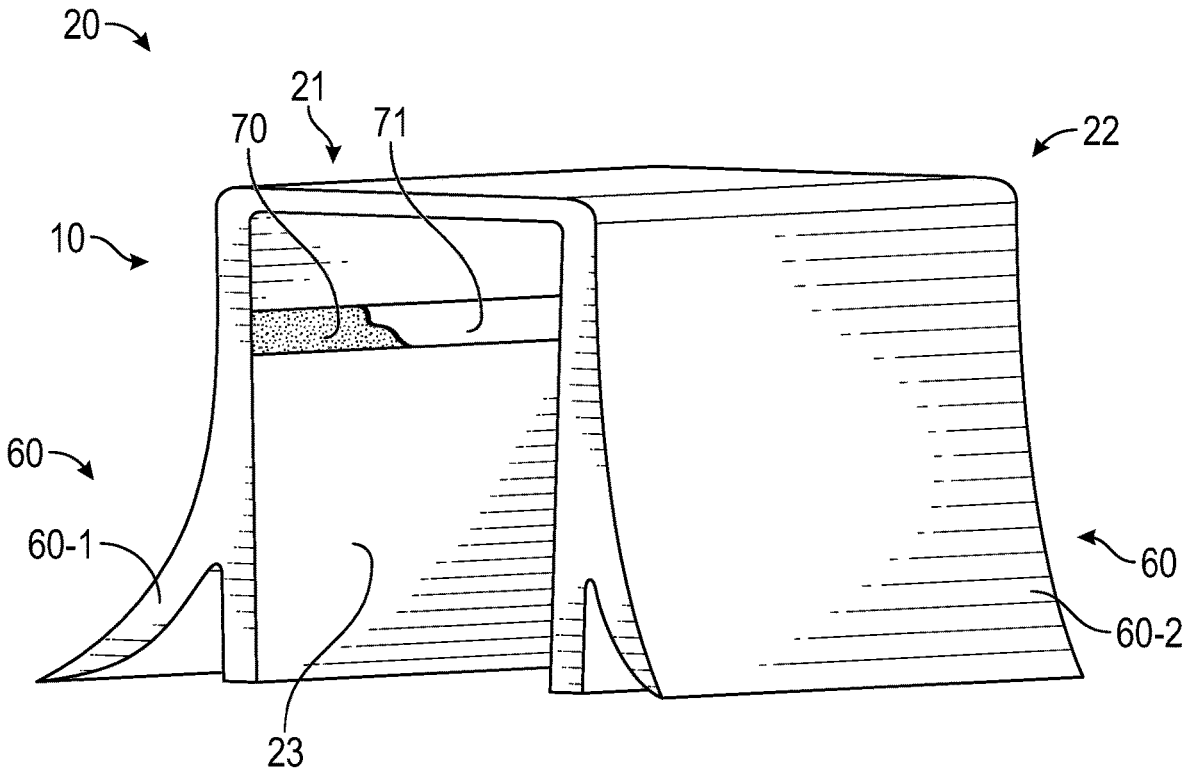
FIG. 2 is a side perspective view of one cabinet protector of FIG. 1.
Figure 3:
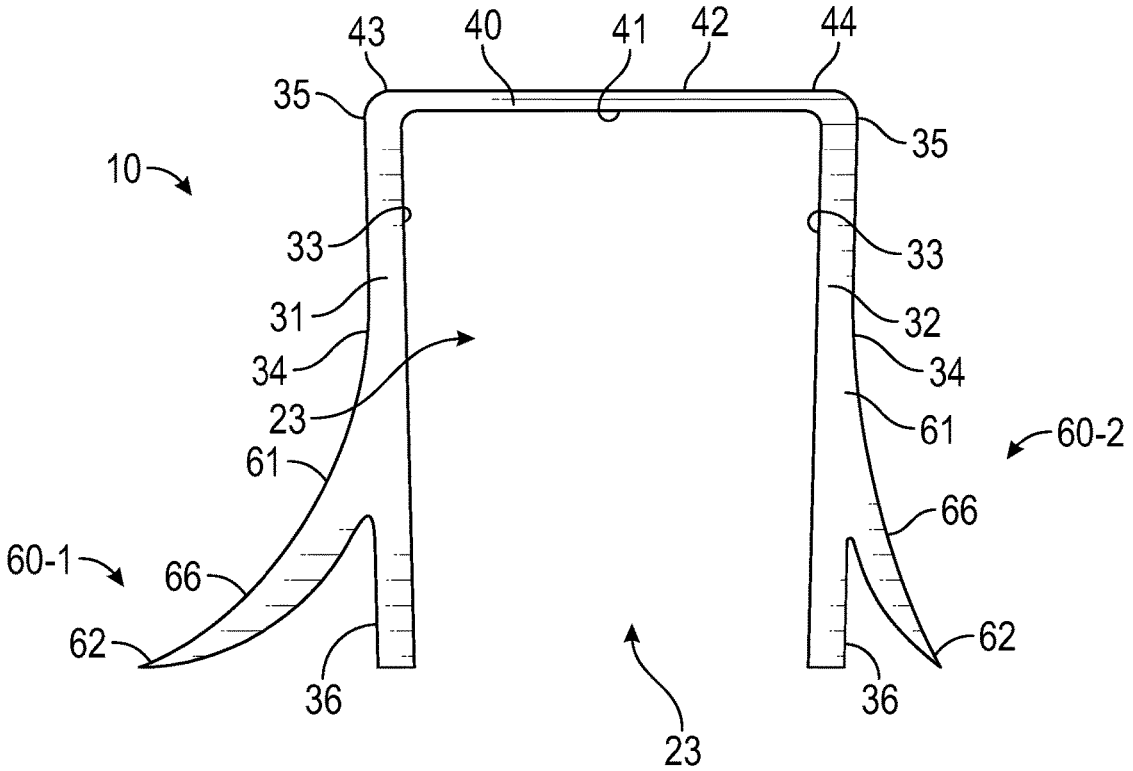
FIG. 3 is an end view of the cabinet protector of FIG. 2.

FIG. 2 is a side perspective view of a preferred embodiment of cabinet protector 10 of FIG. 1 and FIG. 3 is an end view of protector 10 of FIG. 2. Cabinet protector 10 is generally a section of resilient U-channel edging 20 that has a first end 21 and a second end 22 and generally includes also a first side wall 31, a second side wall 32 spaced apart from first side wall 31 and generally parallel to it, and a top wall 40 connecting the first and second side walls 31, 32.

Each side wall 31,32 includes an inner face 33, an outer face 34, a connected edge 35, and a gripping edge 36. Top wall 40 includes an inner face 41, an outer face 42, a first edge 43 attached to connected edge 35 of first side wall 31, and a second edge 44 attached to connected edge 35 of second side wall 32. The collective inner faces 33 and 41 define a three-sided central channel 23 with a rectangular cross section, adapted to fit on an edge such as top edges 104,109 of cabinet 100.

First side wall 31 and second side wall 32 are generally parallel to each other, but the distance between connected edges 35 is slightly greater than the distance between gripping edges 36. In an exemplary embodiment, the distance between inner faces 33 near connected edges 35 is about 0.81 inch and the distance near gripping edges 36 is about 0.74 inch. In this example, door edge 104 would typically have a nominal thickness between 0.81 and 0.74 inch.

The purpose of the slight slant is to make it easier to slip cabinet protector 10 over edge 104 while assuring a tight grip. To install protector 10, one side wall 31 or 32 would be hooked against the inner surface of edge 104 as the opposing side wall 32 or 31 is stretched slightly away. Top wall inner face 41 slides onto edge 104 easily because it is wider than edge 104. When side wall 32 or 31 is released, it resiliently returns to its designed distance from opposing wall 31 or 32 so that gripping edges 36 are pressed tightly against cabinet door 103. Inner faces 33 of side walls 31, 32 are preferably very smooth to maximize contact area and thus friction against cabinet door 103.

Cabinet structural members such as cabinet doors 103 and drawer fronts 109 that are manufactured in large quantity are typically designed from a menu of stock dimensions and variation from the nominal dimensions is small. Custom cabinetry made for a single room or building is typically produced by less highly automated means, so variation from the nominal dimensions tends to be greater and the dimensions themselves may be unusual. The resilient nature of protector 10 allows protectors 10 that are of given stock dimensions to be used with custom cabinets of slightly differing dimensions. Side walls 31, 32 stretch or compress to fit an unusual thickness of door 103 or drawer front 109 and protector 10 may be cut to fit an unusual width.

The resilient grip design of the preferred embodiment of FIGS. 2 and 3 secures protector 10 in place very well so that protector 10 is not dislodged by being bumped against or by frequent opening and closing of door 103. Should additional securing means be desired, an optional adhesive strip 70 may be applied as tape or a liquid coating onto one inner face 33, protected by a release liner 71 that is removed at the time of installation. Adhesive strip 70 is a removable type of adhesive that does not damage edge 104 and leaves no residue. If handled carefully, adhesive strip 70 may be re-used to install protector 10 again.

Each side wall 31, 32 includes liquid diversion means such as a flange 60. Flange 60 is preferably integral to the body of protector 10 and extends out from outer face 34 of each side wall 31, 32. Flange 60 includes a connected end 61 attached to side wall 31, 32 and a free, or "drip" end 62 opposite connected end 61. Between ends 61,62 is a diversion body 66 for changing the path of dripped or splashed liquid that falls upon protector 10. The preferred embodiment 10 of FIGS. 2 and 3 can be seen to have a concave profile as viewed from above.

As seen in FIGS. 2 and 3, flange 60-1 connected to first side wall 31 has a shorter, steeper diversion body 66 than does flange 60-2, which is connected to second side wall 32. Flange 60-2 may be expected to divert liquid farther from edge 104 than flange 60-1 does, as well as slow the flow more. Because channel 23 is symmetrical about the transverse axis of protector 10, it is the user's decision which side wall 31, 32 to dispose against exterior face 105 of cabinet door 103. The advantages of having two flanges 60-1 and 60-2 on one protector 10 are that both faces of cabinet door 103 are protected from dripping liquid and that two different profiles for flange 60 may be provided in one protector 10.

Protector 10 may be manufactured such as by an extrusion process or a molding process. Extrusion is generally faster and less expensive than molding because it is a continuous process and the dies for shaping the material are less complex. Molding has the advantage of being able to create more complex designs. There are a great number of thermoplastic materials that are suitable for either process, including polymers, co-polymers, and compound polymers.

In general, suitable materials must be unaffected by hot water and resistant to oil, weak acids, weak bases, and common solvents such as short chain alcohols. A suitable material is tough enough that drip ends 62 will not readily tear, soft enough that a person bumping against flange 60 will not be scratched or bruised, and resilient enough that gripping ends 36 will spring back to their designed separation after many cycles of installation and removal. Optional additives include pigments, opacifiers, biocides for bacteria or mold, and particles for modifying the surface gloss.

Figure 4A:
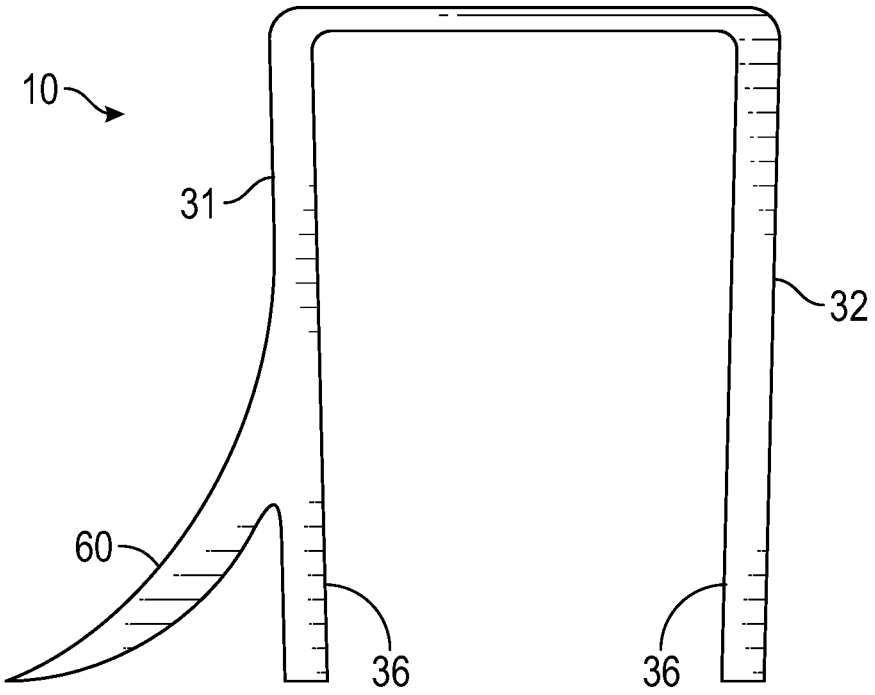
FIG. 4A is multiple an a right end view of an alternative preferred embodiment of the invention.
Figure 4B:
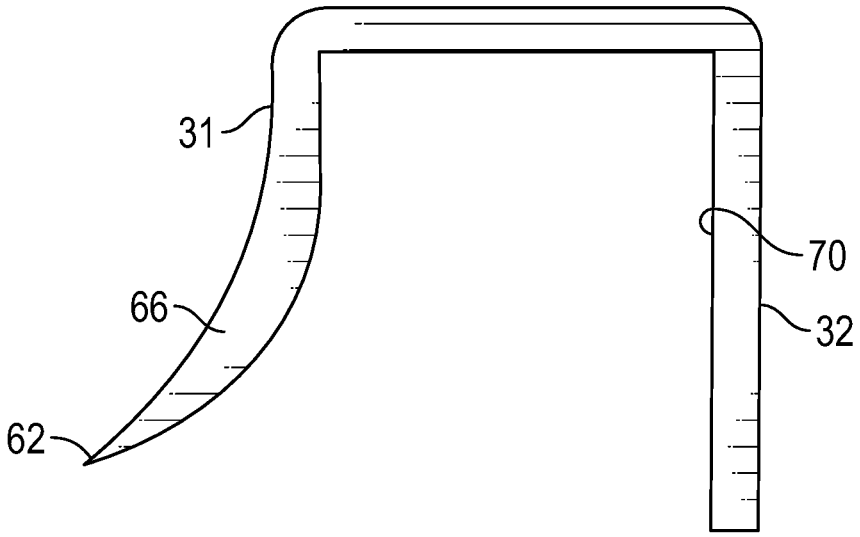
FIG. 4B is a right end view of a second alternative preferred embodiment of the invention.
Figure 4C:
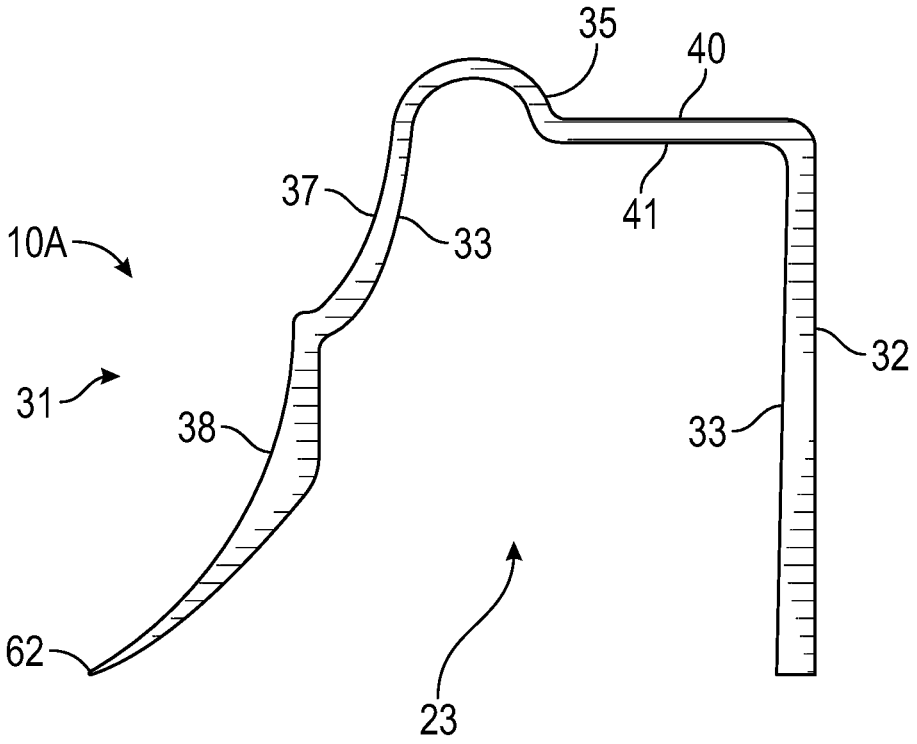
FIG. 4C is a right end view of a third alternative preferred embodiment of the invention.

FIGS. 4A, 4B, and 4C depict[[s]] additional alternative embodiments of the invention. FIG. 4A is a side view of protector 10 that has a flange 60 attached to only one side wall, such as second side wall 32. FIG. 4B has a side wall, such as second side wall 32, that is attached to flange 60 end-to-end so that side wall 32 is essentially the same as diversion body 66 in this embodiment. Because the embodiment of FIG. 4B does not have a pair of gripping edges 36 opposing one another, this embodiment typically will include optional adhesive strip 70.

FIG. 4C is a side view of [[an]] a preferred alternative embodiment 10A of the present invention, adapted to fit a cabinet door 103 or drawer front 108 that has a high-relief rail around the perimeter of the front surface. Cabinet protector 10A includes a vertical first side wall 31, a horizontal top wall 40, and a second side wall 32 that is integrated end-to-end with flange 60, as in the embodiment of FIG. 4B. Connected edge 35 of second side wall 32 curves upward to accommodate a raised molding along the edge of door 103 or drawer front 109, then curves down to cover a raised panel. Flange 60, below the inflection point of the curve of diversion body 66, is elongated and doubles as a finger pull 110 for door 103 or drawer 107.

Figure 5:
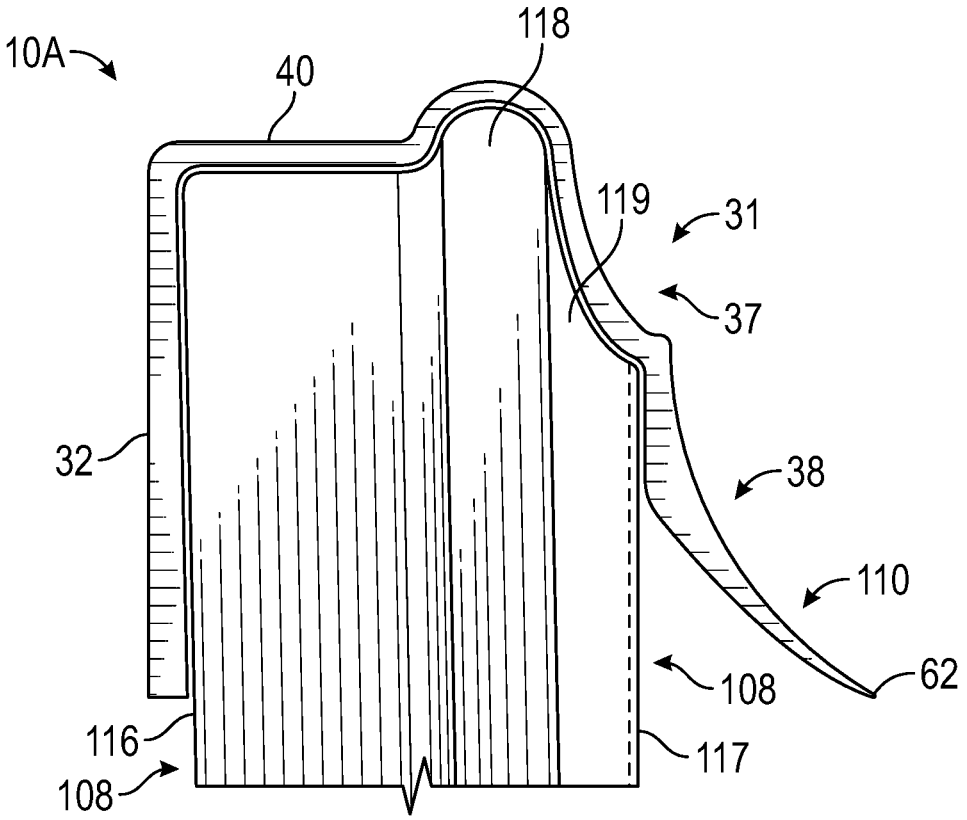
FIG. 5 is a left side view of [[an]] third alternative preferred embodiment of FIG. 4C, mounted on a drawer front, partly cut away.

FIG. 5 is a left side view of embodiment 10A of FIG. 4C, mounted on a cabinet member 102 such as a drawer front 108, partly cut away. Drawer front 108 has a complex exterior face 117 including a rail frame 118 around the periphery of exterior face 117 and a raised panel 119 centered in exterior face and a flat interior face 116.

Cabinet protector 10A includes a rear wall 32 for contacting interior face 116 of drawer front 108, a top wall 40, and a front wall 31, which has a complex curvature. Rear wall 32 and front wall 31 are attached to top wall 40 as described above for protector strip 10. Front wall 31 includes an upper portion 37 that curves up and over rail 118, then curves outwardly to overlie raised panel 119. Front wall 31 further includes a lower portion 38 that extends outwardly away from exterior face 117. Lower portion 38 has two functions: first, as a liquid diverting flange 60 including a drip end 62 and second, as a handle or finger pull 110 for opening cabinet member 102 with the fingertips.

Cabinet protector 10A typically is flexible enough to fit a very small range of profiles of cabinet member 102, but in practice, different p cabinet protector 10A would be designed to optimally fit selected individual cabinet members 102.

Figure 6:
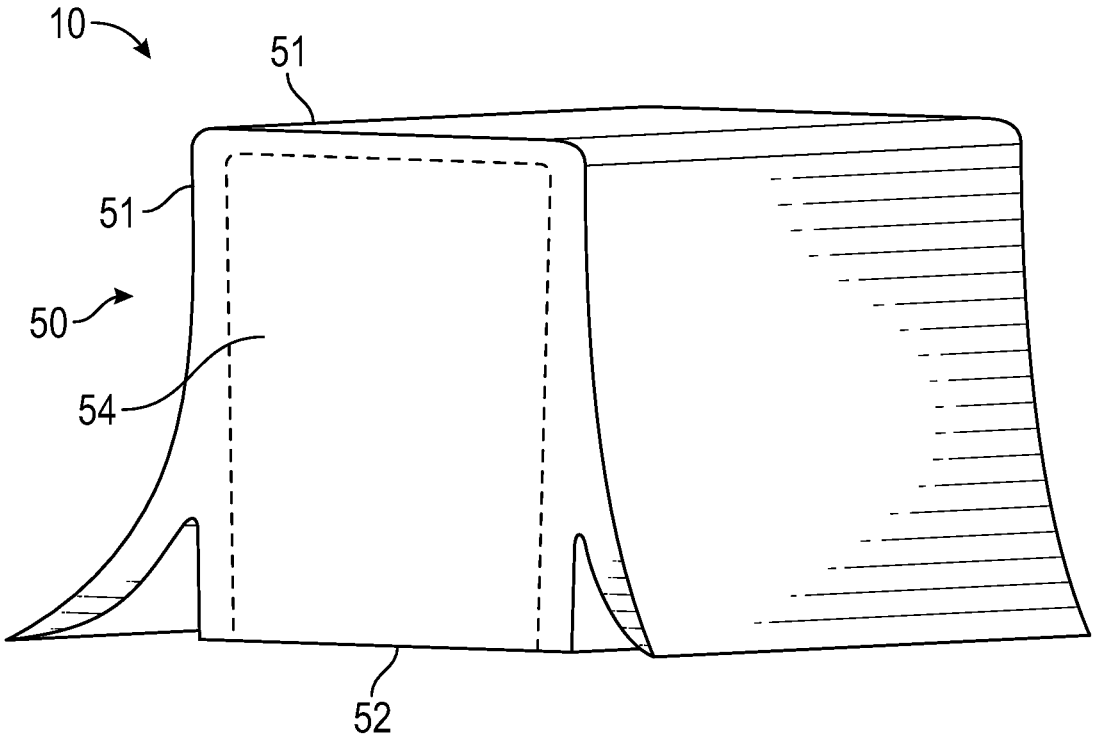
FIG. 6 is a side perspective view of an alternative preferred embodiment of the cabinet protector of FIG. 2.

FIG. 6 is a side perspective view of an alternative preferred embodiment of the protector 10 of FIG. 2. First end 21 is shown as sealed with an end cap 50. End cap 50 includes an inner face (not seen) and an outer face 54 as well as one or more connected edges 51, each attached to a side wall 31,32 or top wall 40. End cap 50 further includes a free edge 52 that is not connected to any part of U-channel edging 20. Inner faces 33 of side walls 31, 32 and inner face

41 of top wall are seen in dashed lines. End cap 50 provides extra protection for a side edge of cabinet member 102 and further retains protector 10 on top edge 109. Either a single end 21, 22 may be sealed, or both ends 21,22 may include end cap 50.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

For example, although cabinet protectors 10 and 10A have been described as for being installed upon top edges 104, 109 of a cabinet door 103 or a drawer front 108, any such description may be understood to include installation of protector 10 or 10A on a suitable portion of any type of door or drawer, or on similar items that may require protection, such as a shelf.

What is claimed is:

1. A resilient cabinet protector for protecting an edge of a cabinetry member and diverting liquid away from the cabinetry member; comprising:

an elongate strip of U-channel; including:

a first side wall; and a second side wall spaced apart from said first side wall and generally parallel to said first wall; each said side wall including:

an inner face for contacting the cabinet member;

an outer face opposite said inner face;

a connected edge; and a gripping edge opposite said connected edge; and a top wall connecting said first and second side walls; said top wall including:

an inner face for contacting the cabinetry member;

an outer face opposite said inner face;

a first edge connected to said connected edge of said first side wall; and a second edge connected to said connected edge of said second side wall;

said inner faces of said first and second side walls and of said top wall combining to define a central channel adapted to receive the edge of the cabinetry member; and wherein said outer face of at least one said side wall further includes:

a water-diverting flange; including:

a flange connected end connected to said side wall outer face;

a drip end opposite said connected end and spaced away from the cabinetry member; and a diversion body disposed between said flange connected end and said drip end, for diverting liquid away from the cabinetry member toward said drip end.

2. The resilient cabinet protector of claim 1 wherein the distance between said connected ends of said first and second side wall inner faces is greater than the thickness of the cabinetry edge being protected and the distance between said gripping ends of said inner faces of said first and second side walls is less than the thickness of the cabinetry edge being protected.

3. The resilient cabinet protector of claim 2 wherein the distance between said gripping ends of said inner faces of said first and second side walls in the range of 89 to 93 percent of the distance between said inner faces of said connected ends of said first and second side walls.

4. The resilient cabinet protector of claim 1 wherein both said side wall outer faces include a water-diverting flange; said two flanges having different profiles, such that a user may choose which said water-diverting flange is disposed toward the exterior of the cabinetry member being protected.

5. The resilient cabinet protector of claim 1 wherein at least one end of said channel is covered by an end cap connected at its edges to said first side wall, said second side wall, and said top wall.

* * * * *